US011094442B2

(12) United States Patent
Lahajnar

(10) Patent No.: US 11,094,442 B2
(45) Date of Patent: Aug. 17, 2021

(54) ELECTROMAGNETIC LINEAR ACTUATOR

(71) Applicant: KOLEKTOR GROUP D.O.O., Idrija (SI)

(72) Inventor: Franci Lahajnar, Cerkno (SI)

(73) Assignee: KOLEKTOR GROUP D.O.O., Idrija (SI)

( * ) Notice: Subject to any disclaimer, the term of this patent is extended or adjusted under 35 U.S.C. 154(b) by 190 days.

(21) Appl. No.: 16/539,230

(22) Filed: Aug. 13, 2019

(65) Prior Publication Data

US 2019/0362875 A1 Nov. 28, 2019

Related U.S. Application Data

(63) Continuation of application No. PCT/EP2018/052935, filed on Feb. 6, 2018.

(30) Foreign Application Priority Data

Feb. 15, 2017 (DE) ..... 10 2017 103 090.5

(51) Int. Cl.
*H01F 7/122* (2006.01)
*H01F 7/16* (2006.01)
(Continued)

(52) U.S. Cl.
CPC ..... *H01F 7/1615* (2013.01); *H01F 3/10* (2013.01); *H01F 7/122* (2013.01); *H01F 7/13* (2013.01);
(Continued)

(58) Field of Classification Search
CPC ..... H01F 7/13; H01F 7/122; H01F 7/1615; H01F 2007/1692
See application file for complete search history.

(56) References Cited

U.S. PATENT DOCUMENTS 3,202,886 A 8/1965 Kramer
3,503,022 A 3/1970 Burdett
(Continued)

FOREIGN PATENT DOCUMENTS

CN 101908420 A 12/2010
DE 2 423 722 A 5/1973
(Continued)

OTHER PUBLICATIONS

International Search Report issued for corresponding International Patent Application No. PCT/EP2018/052935, dated Jun. 26, 2018, with an English translation.

*Primary Examiner* — Ramon M Barrera
(74) *Attorney, Agent, or Firm* — Myers Wolin, LLC

(57) ABSTRACT

An electromagnetic linear actuator is provided having a housing having a casing section and an end piece, a coil arrangement having two coils which extend about a common axis, are wound in opposite directions and are offset axially from one another, an armature arrangement mounted displacably in the housing along the axis, and a shaft, which passes through the end piece. A magnet arrangement at the end of the shaft has an axially magnetized permanent magnet and two disc-shaped flux conducting pieces are arranged on a front side. The first coil which faces away from the free end of the shaft has a region with a reduced internal diameter. A core of a magnetically active material is held in the coil. In each end positions of the armature arrangement, at least 50% of the axial length of the magnet arrangement is overlapped by one of the coils.

15 Claims, 3 Drawing Sheets

(51) Int. Cl.
*H01F 3/10* (2006.01)
*H01F 7/13* (2006.01)

(52) U.S. Cl.
CPC ..... *H01F 7/1646* (2013.01); *H01F 2003/103* (2013.01); *H01F 2007/1692* (2013.01)

(56) References Cited

U.S. PATENT DOCUMENTS

| | | | |
|---|---|---|---|
| 3,504,315 | A | 3/1970 | Stanwell |
| 4,071,042 | A | 1/1978 | Lombard et al. |
| 4,490,815 | A | 12/1984 | Umehara et al. |
| 4,686,501 | A | 8/1987 | Palmier et al. |
| 4,779,582 | A | 10/1988 | Lequesne |
| 2004/0100345 | A1 | 5/2004 | Kobayashi et al. |
| 2014/0028420 | A1 | 1/2014 | Scanlon |

FOREIGN PATENT DOCUMENTS

| | | | |
|---|---|---|---|
| DE | 34 37 106 | A1 | 5/1985 |
| EP | 1 275 886 | A2 | 1/2003 |
| JP | 57-198612 | A | 12/1982 |

ELECTROMAGNETIC LINEAR ACTUATOR

CROSS REFERENCE TO RELATED APPLICATIONS

This application is a continuation under 35 U.S.C. § 120 of International Application PCT/EP2018/052935, filed Feb. 6, 2018, which claims priority to German Application No. 10 2017 103 090.5, filed Feb. 15, 2017, the contents of each of which are incorporated by reference herein.

FIELD OF THE INVENTION

The present invention relates to an electromagnetic linear actuator. In particular, the present invention relates to an electromagnetic linear actuator comprising a housing provided with a casing portion and an end piece, a coil arrangement disposed in the housing with two coils, which extend around a common axis, are wound in opposition and are axially offset relative to one another, and an armature arrangement mounted displaceably in the housing along the axis between two end positions, with a shaft passing through the end piece and a permanent magnet arrangement provided with an axially magnetized permanent magnet disposed thereon and two disk-shaped flux-conducting pieces disposed thereon at the end face, wherein at least 50% of the axial length of the permanent magnet arrangement is overlapped by one of the two coils in each of the two end positions of the armature arrangement.

BACKGROUND

Electromagnetic linear actuators are known and in use in the most diverse embodiments. Their respective structural shape and individual configuration are guided by the respective application. For example, they depend on the space available for the application in question, on the necessary positioning path (or switching path) that the shaft travels between the two end positions, and on the necessary force that the said shaft must be capable of exerting for such travel on a component to be actuated. The attainable switching dynamics, i.e. the time that the shaft needs for movement from one end position to the other is also an important variable for many applications. In this context, it is conceivable that dependences exist to some extent between the various aspects and performance characteristics. For example, in general, the positioning force (or switching force) supplied by the shaft is related to the overall size in the sense that larger linear actuators are able to supply a larger positioning force. Among these, however, the attainable switching dynamics typically suffer due to the larger masses to be moved. Furthermore, switching dynamics and switching force are related to one another inasmuch as the force needed for acceleration of the armature arrangement reduces the switching force that is effective in this phase of movement of the armature arrangement.

The electromagnetic linear actuators corresponding to the initially indicated structural shape may be distinguished by the possibility of two stable switched states, as is the case, for example, for the linear actuators according to JP 57-198612 A and EP 1275886 A2. Accordingly, they may be constructed as so-called bistable actuators, in which the shaft—by virtue of the interaction of the permanent magnet arrangement with the housing—Is able to maintain each of its two end positions without loading (current energization) of the coil arrangement, although this is also correspondingly true in part for similar structural shapes with a different embodiment of the permanent magnet arrangement and/or of its matching with the coil arrangement (see, for example, U.S. Pat. Nos. 3,504,315 A, 3,503,022 A, 4,490,815 A, CN 101908420 A, U.S. Pat. No. 3,202,886 A and DE 2423722 A). Besides the aspects already discussed in the foregoing, yet a further viewpoint for such bistable electromagnetic actuators is the force acting on the armature arrangement in the stable switched states (holding force); this is so because obviously a higher holding force typically acts in the sense of reduced initial acceleration of the armature arrangement and thus impairs the switching dynamics.

U.S. Pat. No. 4,071,042 A discloses an electromagnetic linear actuator of the class in question here which, as specified in the preamble of claim 1, is distinguished in addition to the features mentioned in the introduction by the fact that the permanent magnet arrangement is disposed in end position on the shaft. However, this electromagnetic linear actuator is not constructed as a bistable actuator but instead is designed for actuation of a hydraulic servo valve, for which purpose a deflection of the armature arrangement from a neutral middle position is desired, in a manner proportional to the current energization of the coil arrangement.

US 2014/0028420 A1 also discloses a linear actuator of the class in question here. This is specially designed for an asymmetric characteristic of the movement of the armature arrangement. It is provided with an end ring, which is positioned at the end region of the casing portion of the housing disposed opposite the end piece and which modifies the magnetic flux.

US 2004/0100345 A1 discloses an electromagnetic linear actuator designed for use on a gear mechanism. This is provided with two coils disposed in a casing-like housing and having a central flux-conducting piece between them. In end position, a fixed flux-conducting piece, through which there extends the shaft of an armature arrangement, on which a first movable flux-conducting piece is disposed in end position, is inserted in end position into the housing. Between the fixed flux-conducting piece and the first movable flux-conducting piece, a second movable flux-conducting piece is situated that is movable both relative to the housing and relative to the armature arrangement. Depending on the current energization of the one coil, of the other coil or of both coils, the armature arrangement assumes one of three defined positions.

The present invention has as an objective providing an electromagnetic linear actuator of the type mentioned in the introduction, which is distinguished by improved operating behavior compared with the prior art. In this sense, it is intended in particular to provide a highly dynamically operating electromagnetic linear actuator of the type mentioned in the introduction having particularly high positioning force.

SUMMARY

According to the invention, this object is achieved in that, in an electromagnetic linear actuator of the class in question here, the first coil turned away from the free end of the shaft is provided at its end turned away from the free end of the shaft with a region having a reduced inside diameter, wherein the region of the first coil having a reduced inside diameter radially overlaps the permanent magnet arrangement, and a core of a magnetically active material is received in the first coil in end position. The radial overlapping of the permanent magnet arrangement realized within the scope of the invention by the region of the first coil having a reduced inside diameter is to be understood to the effect that the outside diameter of the permanent magnet arrangement is larger than the inside diameter of the region of the first coil having a reduced inside diameter. A decisive advantage that can be achieved in inventive configurations of the electromagnetic linear actuator is the optimal variation, which was previously unknown and will be explained in detail hereinafter, of the electromagnetic force that is active between the stator arrangement and the armature arrangement. This variation of the electromagnetic force that is active on the armature arrangement permits—despite a notable holding force acting on the armature arrangement in its first end position—a particularly high initial acceleration of the armature arrangement, wherein an electromagnetic force that behaves particularly uniformly is able to act on the armature arrangement over its further positioning path, which acts favorably both on the further acceleration of the armature arrangement and on the supplied switching force. Toward the end of the positioning path, a significant rise of the positioning force is still possible, which is particularly favorable in typical application situations. Specifically, the particularly homogeneous behavior of the electromagnetic force exerted on the armature arrangement over a large part of the positioning path is extremely advantageous.

A first preferred further development of the invention is characterized in that the core—received in end position in the first coil of the coil arrangement—overlaps the entire axial extent of the region of the first coil having a reduced inside diameter. This favors a force profile that brings about a particularly high initial acceleration of the armature arrangement.

For the force profile, it is further particularly favorable if—according to another preferred further development of the invention—the axial spacing between the first and second coils is not substantially larger than is absolutely necessary from the viewpoint of winding technology. Ideally, when the first and the second coil of the coil arrangement are continuously wound—particularly preferably on a common carrier sleeve of magnetically inactive material—the axial spacing existing between the first and the second coil is limited to the extent needed for damage-free 180° bending of the winding wire. In practice, the spacing in question should not exceed more than 50% of the extent absolutely necessary in terms of winding technology.

According to another preferred further development of the invention, it is provided that no flux-conducting piece is disposed between the first coil and the second coil. This would lead to an inhomogeneous force profile and from the viewpoint of the inventive design of the electromagnetic linear actuator would act disadvantageously on its operating behavior.

Yet another preferred further development of the invention is characterized in that, in the first end position of the armature arrangement, in which the permanent magnet arrangement is overlapped by more than 50% by the first coil (and typically the shaft is retracted into the end piece), an axial gap exists between the core and the neighboring flux-conducting piece of the permanent magnet arrangement. In this way the breakaway force necessary to move the armature arrangement—against the acting holding force—out of the first end position can be positively influenced. One possibility for achieving this particularly simply consists in that the shaft passes axially through the permanent magnet arrangement and protrudes a little out of this. Thus the armature arrangement with the overhang in question of the shaft is able to abut the core and hold the neighboring flux-conducting piece of the permanent magnet arrangement at a spacing from this. In other respects, the shaft consists advantageously of a magnetically inactive material, preferably stainless steel. This is favorable not only for the function, mentioned in the foregoing, as a "stop" for the armature arrangement, but also due to the reduction of the magnetic inductance that is attainable in this way as well as of the associated concentration of the magnetic field on the external environment of the permanent magnet arrangement that interacts with the coil arrangement.

Furthermore, it is favorable for the force profile when—according to yet another preferred further development of the invention—the overlapping of the permanent magnet arrangement by the first coil in the first end position of the armature arrangement is smaller than the overlapping of the permanent magnet arrangement by the second coil in the second end position of the armature arrangement. Thus, for example, the permanent magnet arrangement may be axially overlapped to the extent of 55% to 85% by the first coil in the first end position of the armature arrangement and to a greater extent, in a proportion of between 65% and 100%, by the second coil in the second end position of the armature arrangement. Particularly preferred ranges lie in an axial overlapping of the permanent magnet arrangement to the extent of 65% to 75% by the first coil in the first end position of the armature arrangement and to the extent of 75% to 90% by the second coil in the second end position of the armature arrangement.

Yet another preferred further development is characterized in that the end piece of the housing is designed as a mounting and guide block. In this sense, the end piece of the housing is provided not only with such structural features (e.g. a flange, a screw-in thread, a mounting extension, etc.) that serve for attachment of the linear actuator to a built-in structure (e.g. the cylinder head of an internal combustion engine in the case of use of the linear actuator for camshaft positioning) provided with the element to be actuated but also with the structural features serving for guidance of the armature arrangement (e.g. a bore constructed as a sliding guide for the shaft of the armature arrangement). In a particularly preferred configuration, the said armature arrangement is mounted in displaceably guided manner exclusively in the mounting and guide block.

Advantageously, the permanent magnet arrangement is further provided on its outer circumference with at least one compensating channel extending over the axial length. This proves to be favorable in terms of the switching dynamic, since in this way if it possible for air to flow around the permanent magnet arrangement with the least resistance (through the at least one compensating channel) even in the case of a relatively small radial gap—which acts positively on the efficiency—between the permanent magnet arrangement and the coil arrangement surrounding it (outside the at least one compensating channel) during movement of the armature arrangement.

In a quite particularly distinct way, the advantages explained in the foregoing for the present invention are manifested when the linear actuator is constructed as a double linear actuator with two armature arrangements and respective associated coil arrangements disposed side-by-side in parallel with one another, wherein the housing is provided with two separate casing portions and one common end piece, through which both shafts pass. Thus two functionalities can be achieved in the narrowest space, wherein the fact that the end piece may be magnetically effective for both units together contributes to the compactness. The same is true for a common closure plate of the housing advantageously provided opposite the end piece.

Preferably, the double linear actuator explained in the foregoing is provided with an enclosure having a common protective cap surrounding the two casings of the housing. Particularly preferably, the latter is joined tightly to a flange plate or to a flange ring attached to the end piece.

BRIEF DESCRIPTION OF THE DRAWING

The present invention will be explained hereinafter on the basis of a preferred exemplary embodiment illustrated in the drawing, wherein.

DETAILED DESCRIPTION OF THE PREFERRED EMBODIMENTS

Figure 1:
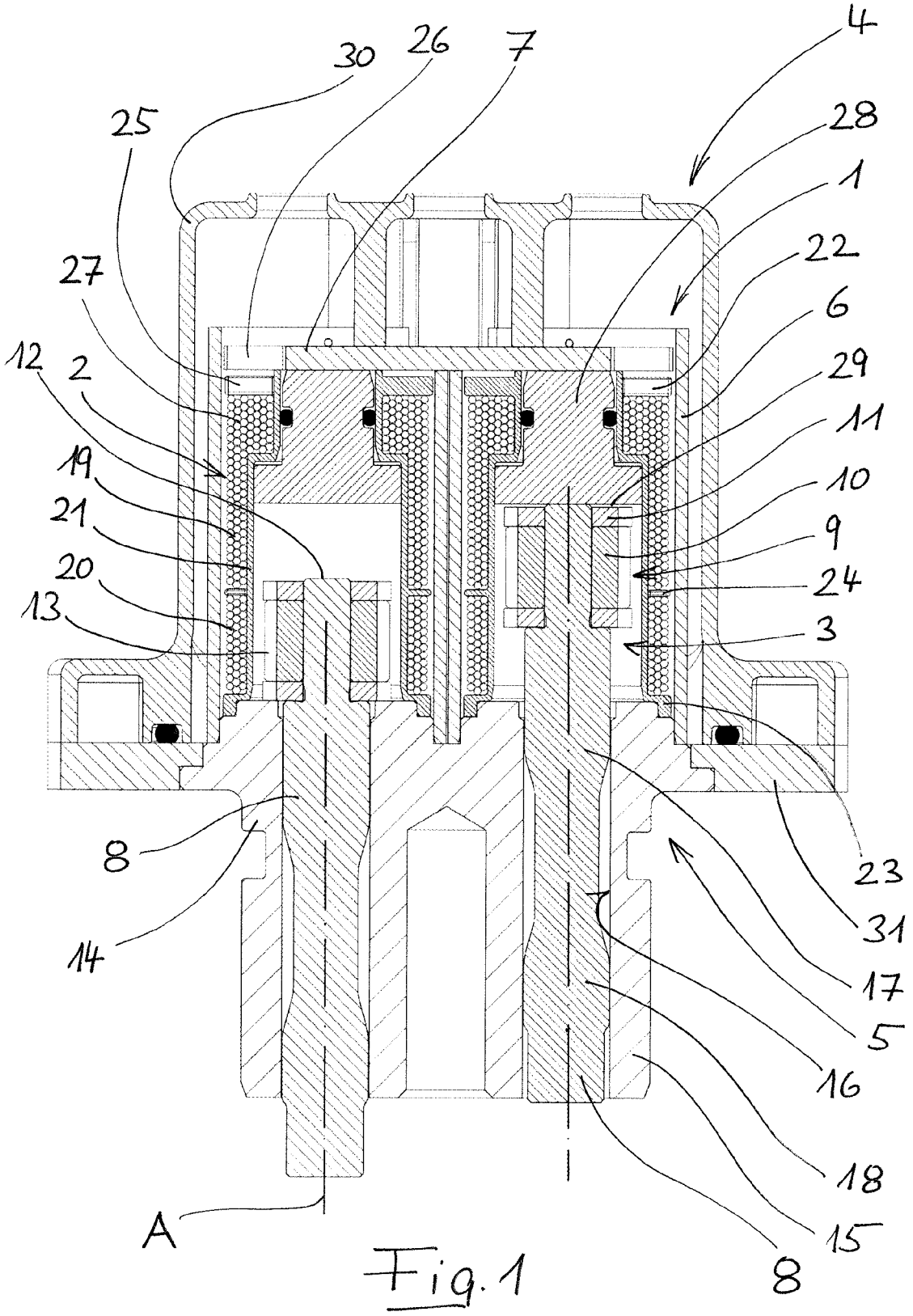
FIG. 1 shows an axial section through an electromagnetic linear actuator according to the invention, constructed as a double linear actuator.
Figure 2:
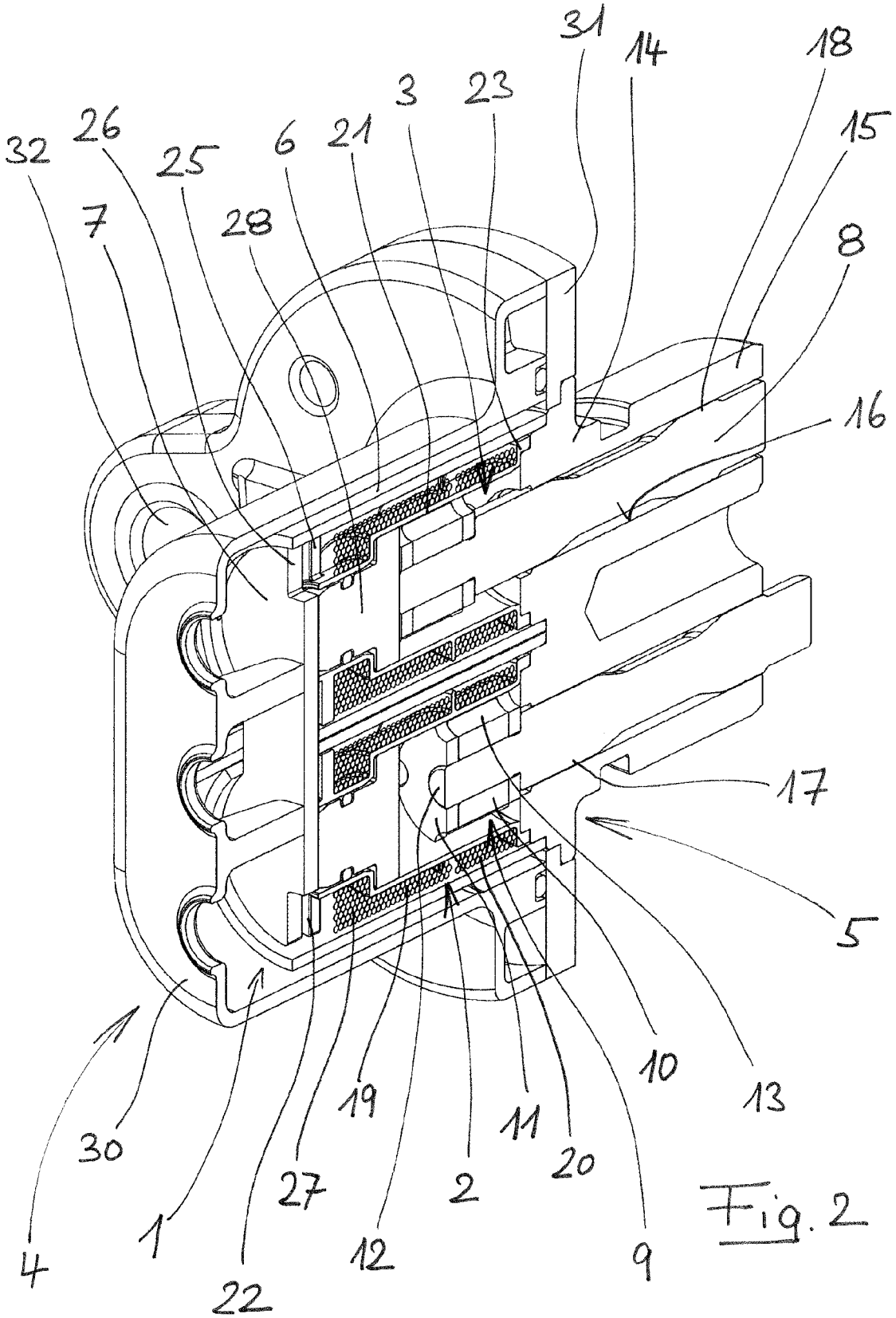
FIG. 2 shows the linear actuator according to FIG. 1 in a cutaway perspective view and FIG. 3 shows a diagram for illustration of the curves of the current flow through the coil arrangement, of the resulting force acting on the armature arrangement and of the movement of the armature arrangement over time after the beginning of current energization of the coil arrangement.

The electromagnetic linear actuator constructed as a double linear actuator and illustrated in FIGS. 1 and 2 of the drawing comprises four functional main components in the form of a housing 1, two coil arrangements 2 received therein, two armature arrangements 3 and one enclosure 4.

Housing 1 comprises an end piece 5, two cylindrical casing portions 6 and, disposed opposite end piece 5, a common closure plate 7. These parts are made of a ferromagnetic material. For centering and accurate positioning of casing portions 6 in place on end piece 5 while establishing good magnetic flux behavior, the said end piece 5 is inserted in respectively precisely fitting manner by means of a projection in end position into the respective casing portion 6. In the opposite end region, the two casing portions 6 respectively have an opening (disposed opposite one another), through which closure place 7 passes. In the region of each opening, the two casing portions 6 are in abutting contact with closure plate 7. In other respects, closure plate 7 conforms in a manner as gap-free as possible to the inside contour of casing portions 6. A coil arrangement 2 is disposed in each of the two casing portions 6.

The two armature arrangements 3 respectively comprise a shaft 8 and a permanent magnet arrangement 9 disposed in end position thereon with an axially magnetized permanent magnet 10 and two disk-shaped flux-conducting pieces 11 disposed thereon at the end face. The said shaft 8—consisting of a magnetically inactive material—passes axially with a region of reduced diameter, in such a way through the permanent magnet arrangement 9—which has a corresponding axial through-bore—that at its opposite end face it protrudes a little from flux-conducting piece 11 and forms an overhang 12. At the outer circumference of the respective permanent magnet arrangement 9, four compensating channels 13 are provided that extend over its axial length.

The shaft 8 of each of the two armature arrangements 3 is guided in axially displaceable manner in end piece 5 along an axis A. For this purpose, end piece 5 is designed as mounting and guide block 14. It has an axial shoulder 15 and is provided with two bores 16 designed as sliding guide for the respective shaft 8 of armature arrangement 3. Each shaft 8 is provided with two guide portions 17, 18, which correspond to bore 16, are matched to it, are spaced apart from one another and between which shaft 8 tapers to a reduced diameter. Shafts 8 pass through end piece 5. In FIGS. 1 and 2, the said armature arrangement 3 is shown at the top in the first end position with shaft 8 completely retracted into housing 1, while at the bottom armature arrangement 3 is shown in the second end position with shaft 8 maximally extended from housing 1.

Coil arrangements 2 respectively comprise two coils 19, 20, specifically a first coil 19—disposed turned away from the free end of shaft 8 guided in end piece 5—and a second coil 20, which extend around axis A, are wound in opposition and are axially offset relative to one another. The said two coils 19, 20 are received on a common carrier sleeve 21 of magnetically inactive material. By means of a first end plate 22, a second end plate 23 and an intermediate ring 24, respectively the outer face of carrier sleeve 21 is subdivided into two compartments for receiving first coil 19 and second coil 20. First end plate 22 and intermediate ring 24 respectively have knockouts 25 for routing through the winding wire of the two coils, which are wound continuously but with inversion of the winding direction at the transition from first coil 19 to second coil 20. Closure plate 7 of housing 1 is also provided with knockouts 26 for routing through the respective winding wire.

First coil 19 is respectively provided at its end turned away from the free end of shaft 8 with a region 27 having a reduced inside diameter. For this purpose, carrier sleeve 21 is correspondingly constructed in stepped manner. The said reduced inside diameter of first coil 19 is chosen in such a way in region 27 in question that permanent magnet arrangement 9 and first coil 19 overlap one another radially in an annular overlap zone in each region 27 having a reduced inside diameter.

In the end region of carrier sleeve 21, a core 28 of a magnetically active material is inserted in a manner bearing without gaps on the end face of closure plate 7. This overlaps the entire axial extent of region 27 of first coil 19 having a reduced inside diameter. For this purpose, it is configured in stepped manner corresponding to carrier sleeve 21. In the first end position of armature arrangement 3 (shown at the top in FIGS. 1 and 2), overhang 12 of shaft 8 projecting from permanent magnet arrangement 9 bears on core 28. In this way, flux-conducting piece 11 adjacent to core 28 holds permanent magnet arrangement 9 at a corresponding distance from core 28, i.e. an axial gap 29 exists between core 28 and the neighboring flux-conducting piece 11 of permanent magnet arrangement 9.

The axial extent of permanent magnet arrangement 9 and the respective axial extent and arrangement of first coil 19 and of second coil 20 are matched to one another in such a way that the axial overlapping of permanent magnet arrangement 9 by first coil 19 in the first end position of armature arrangement 3 is smaller than the axial overlapping of permanent magnet arrangement 9 by second coil 20 in the second end position of armature arrangement 3. Thus the axial overlapping of permanent magnet arrangement 9 by first coil 19 in the first end position of armature arrangement 3 is approximately 70%, whereas the axial overlapping of permanent magnet arrangement 9 by second coil 20 in the second end position of armature arrangement 3 is approximately 82%.

Enclosure 4 serving as protection from external influences comprises a common protective cap 30, which surrounds the two casing portions 6 of housing 1 and is tightly joined to a flange ring 31 attached to end piece 5. Protective cap 30 and flange ring 31 are provided with bores 32, which are aligned with one another and are used for fastening the double linear actuator on an existing structure by means of corresponding screws.

The embodiment of the linear actuator illustrated in the drawing is optimized, from the perspective of highest switching dynamic and maximum switching force, for movement of armature arrangement 3 from the first to the second end position. In view of a simple structural design with only minimum dimensions, electromagnetically operated resetting of armature arrangement 3 from the second end position to the first end position is not included in this said embodiment. In this embodiment, such resetting takes place by means of a separate external resetting device acting on the respective shaft 8. Nevertheless, the shown double linear actuator may also be modified with respect to electromagnetically operated resetting of the armature arrangement. For this purpose, second coil 20 in particular could be lengthened somewhat and provided at its end turned toward the free end of shaft 8 with a region having a reduced inside diameter, wherein this region of the second coil having a reduced inside diameter could overlap permanent magnet arrangement 9 radially and a core sleeve of a magnetically active material could be received in end position in second coil 20.

Figure 3:
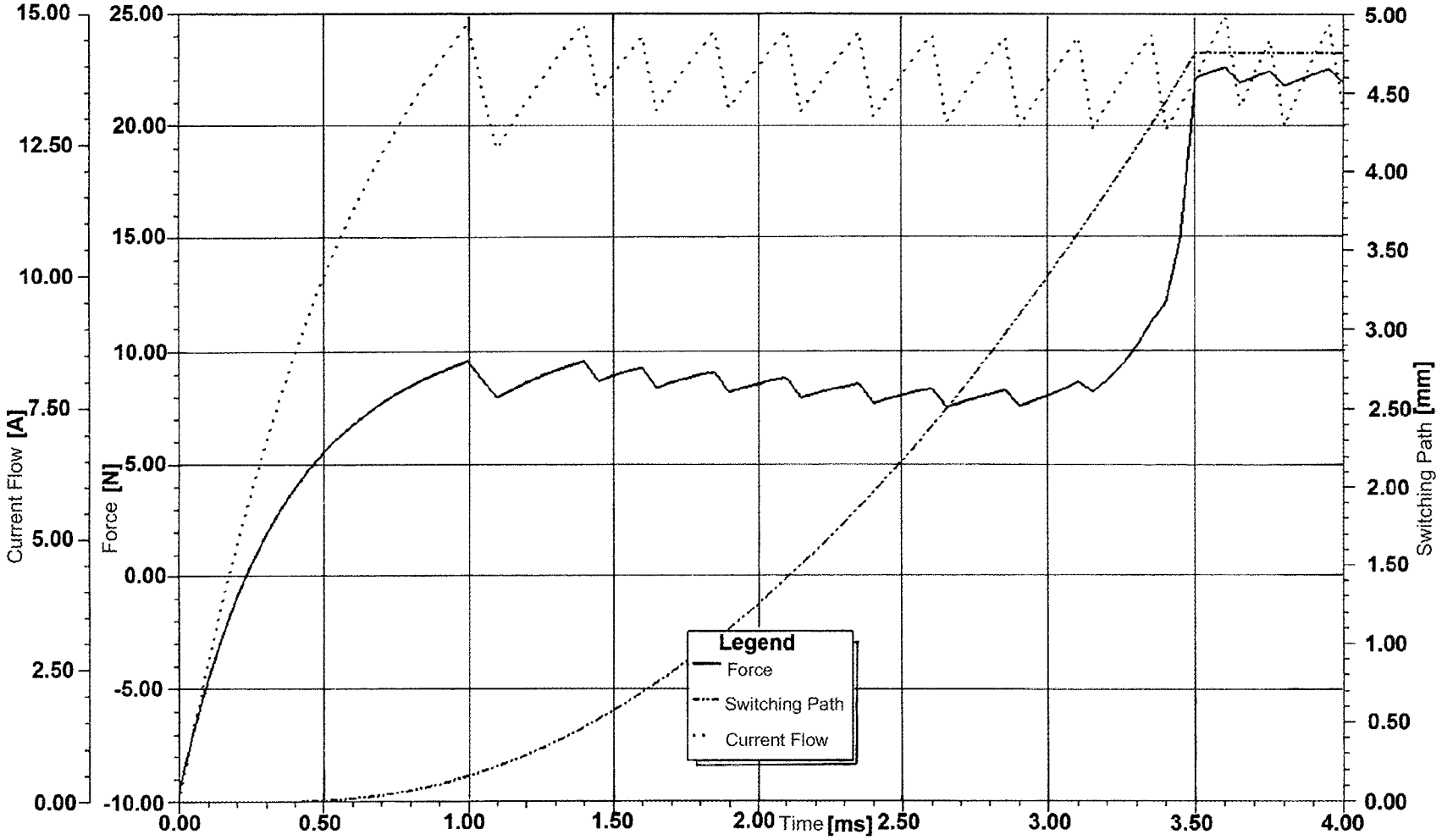

FIG. 3 illustrates the excellent performance data of a double linear actuator configured according to the exemplary embodiment of FIGS. 1 and 2, designed for a stroke of armature arrangements 3 amounting respectively to 4.75 mm and having permanent magnets 9 with a diameter of only 8 mm. Without current energization of coil arrangement 2, armature arrangement 3 is held—by interaction of the respective permanent magnet arrangement 9 with core 28—In its first end position with a holding force of approximately 9.5 N. During current energization of coil arrangement 2, this holding force is already compensated after only 0.25 ms and, due to likewise further rapid increase of the electromagnetically generated force, the movement of armature arrangement 3 already sets in only 0.5 ms after the beginning of current energization (response time). Shaft 8 is lifted from core 21 and the holding force collapses rapidly. Approximately 1 ms after the beginning of current energization, the electromagnetically generated force acting on armature arrangement 3 has reached a plateau of 8.5 N on average, and this is maintained unchanged and with very great uniformity over almost the entire positioning path of armature arrangement 3. Consequently, armature arrangement 3 executes a continuously accelerated movement. Toward its end (starting approximately 3.2 ms after the beginning of current energization of coil arrangement 2 and approximately 1 mm before the second end position is reached), the holding force associated with the second end position of armature arrangement 3 is increasingly added thereto, thus leading to a strongly progressive increase of the total force. Already after only 3.5 ms, armature arrangement 3—after a switching path of 4.75 mm—reaches its second end position. During continued current energization of the coil arrangement, the resulting total force now amounts to approximately 22 N.

What is claimed is:

1. An electromagnetic linear actuator, comprising a housing (1) provided with a casing portion (6) and an end piece (5), a coil arrangement (2) disposed in the housing (1) with two coils (19, 20), which extend around a common axis (A), are wound in opposition and are axially offset relative to one another and an armature arrangement (3) mounted displaceably in the housing (1) along the axis (A) between two end positions, with a shaft (8) passing through the end piece (5) and a permanent magnet arrangement (9) provided with an axially magnetized permanent magnet (10) disposed thereon and two disk-shaped flux-conducting pieces (11) disposed thereon at the end face, wherein:

the permanent magnet arrangement (9) is disposed in end position on the shaft (8) and at least 50% of the axial length of the permanent magnet arrangement (9) is overlapped by one of the two coils (19, 20) in each of the two end positions of the armature arrangement (3), characterized in that the first coil (19) turned away from the free end of the shaft (8) is provided at its end turned away from the free end of the shaft (8) with a region (27) having a reduced inside diameter, wherein the region (27) of the first coil (19) having a reduced inside diameter radially overlaps the permanent magnet arrangement (9), and in that a core (28) of a magnetically active material is received in the first coil (19) in end position.

2. The linear actuator of claim 1, wherein the core (28) overlaps the entire axial extent of the region (27) of the first coil (19) having a reduced inside diameter.

3. The linear actuator of claim 1, wherein the axial spacing between the first and second coils (19; 20) is not substantially larger than is absolutely necessary from the viewpoint of winding technology.

4. The linear actuator of claim 1, wherein no flux-conducting piece is disposed between the first coil (19) and the second coil (20).

5. The linear actuator of claim 1, wherein both coils (19, 20) are received on a common carrier sleeve (21) of magnetically inactive material.

6. The linear actuator of claim 1, wherein in the first end position of the armature arrangement (3), in which the permanent magnet arrangement (9) is overlapped by more than 50% by the first coil (19), an axial gap (29) exists between the core (28) and the neighboring flux-conducting piece (11) of the permanent magnet arrangement (9).

7. The linear actuator of claim 1, wherein the shaft (8) consists of a magnetically inactive material and passes axially through the permanent magnet arrangement (9).

8. The linear actuator of claim 1, wherein the overlapping of the permanent magnet arrangement (9) by the first coil (19) in the first end position of the armature arrangement (3) is smaller than the overlapping of the permanent magnet arrangement (9) by the second coil (20) in the second end position of the armature arrangement (3).

9. The linear actuator of claim 1, wherein the end piece (5) of the housing (1) is constructed as a mounting and guide block (14).

10. The linear actuator of claim 9, wherein the armature arrangement (3) is mounted in displaceably guided manner exclusively in the mounting and guide block (14).

11. The linear actuator of claim 1, wherein the permanent magnet arrangement (9) is provided on its outer circumference with at least one compensating channel (13) extending over the axial length.

12. The linear actuator of claim 1, wherein it is constructed as a double linear actuator with two armature arrangements (3) and respective associated coil arrangements (2) disposed side-by-side, wherein the housing (1) is provided with two separate casing portions (6) and one common end piece (5), through which both shafts (8) pass.

13. The linear actuator of claim 12, wherein the housing (1) is provided with a common closure plate (7) opposite the end piece (5).

14. The linear actuator of claim 12, wherein it is provided with an enclosure (4) having a common protective cap (30) surrounding the two casing portions (6) of the housing (1).

15. The linear actuator of claim 14, wherein the protective cap (30) is joined tightly to a flange ring (31) attached to the end piece (5).

* * * * *